United States Patent [19]

Shimizu

[11] 4,353,274

[45] Oct. 12, 1982

[54] ROLL PAPER FEEDING AND CUTTING SYSTEM

[75] Inventor: Masahiro Shimizu, Kashihara, Japan

[73] Assignee: Sharp Kabushiki Kaisha, Osaka, Japan

[21] Appl. No.: 176,146

[22] Filed: Aug. 7, 1980

[30] Foreign Application Priority Data

Aug. 21, 1979 [JP] Japan ..... 54-106855

[51] Int. Cl.[3] ..... B26D 1/38

[52] U.S. Cl. ..... 83/156; 83/210; 83/236; 83/262; 226/117; 271/265; 271/273

[58] Field of Search ..... 83/203, 205, 209, 236, 83/262, 156, 210; 226/117, 118, 119; 271/265, 270, 272–274, 245–246

[56] References Cited

U.S. PATENT DOCUMENTS

| | | | |
|---|---|---|---|
| 2,480,781 | 8/1949 | Simpson | 226/117 X |
| 2,550,680 | 5/1951 | Ewing et al. | 226/117 |
| 3,174,670 | 3/1965 | Zernov | 226/117 |
| 3,673,905 | 7/1972 | Kono | 83/262 X |
| 3,863,913 | 2/1975 | Hirafuji | 271/270 X |
| 3,966,198 | 6/1976 | Komada et al. | 271/270 X |
| 4,000,671 | 1/1977 | Ashburner | 83/262 X |
| 4,019,025 | 4/1977 | Taniguchi et al. | 271/273 X |
| 4,025,187 | 5/1977 | Taylor et al. | 271/10 X |

FOREIGN PATENT DOCUMENTS

| | | | |
|---|---|---|---|
| 2254558 | 5/1973 | Fed. Rep. of Germany | 83/262 |
| 1339937 | 12/1973 | United Kingdom | 83/262 |

*Primary Examiner*—Frank T. Yost

*Attorney, Agent, or Firm*—Birch, Stewart, Kolasch & Birch

[57] ABSTRACT

A copy paper drawn out from a roll paper is supplied to a copy paper feeding and cutting system in an electrophotographic copying machine or a facsimile device. The copy paper feeding and cutting system includes a paper supply roller for introducing the copy paper into the paper feeding and cutting system, a catching roller for catching the leading edge of the copy paper supplied by the paper supply roller, and a paper holding section for curling the copy paper between the paper supply roller and the catching roller. A cutter is disposed between the paper supply roller and the paper holding section for providing a copy paper of a predetermined length.

3 Claims, 2 Drawing Figures

ROLL PAPER FEEDING AND CUTTING SYSTEM

BACKGROUND AND SUMMARY OF THE INVENTION

The present invention relates to a copy paper feeding and cutting system for a facsimile device or an electrophotographic copying machine which employs a roll paper for use as a copy paper.

The roll paper is frequently used, for the copy paper, in a facsimile system or in an electrophotographic copying machine. For example, in the electrophotographic copying machine, the roll paper should be cut to a desired length to form a single sheet of a copy paper after the paper has passed an electrostatic latent image forming section and before the paper reaches a developing section. If the cutting operation is conducted while the paper is supported straight between the electrostatic latent image forming section and the developing section, a long distance is required. This is not preferable when a compact size facsimile device or electrophotographic copying machine is required.

Accordingly, an object of the present invention is to provide a novel paper feeding and cutting system in a facsimile device or an electrophotographic copying machine.

Another object of the present invention is to minimize the size of a paper cutting section in a facsimile device or an electrophotographic copying machine which employs a roll paper.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a paper feeding roller, a leading edge holder for holding a leading edge of a paper supplied through the paper feeding roller, and a rotatable guide plate disposed between the paper feeding roller and the leading edge holder are correlated with each other so that a paper of a desired length is curled and maintained between the paper feeding roller and the leading edge holder. A cutting device is disposed between the paper feeding roller and the rotatable guide plate to cut the paper in a preselected length.

An electrostatic latent image forming section is positioned upstream of the paper feeding roller, and a developing section is positioned downstream of the leading edge holder. The size of the cutting section can be minimized because the paper is curled between the paper feeding roller and the leading edge holder.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
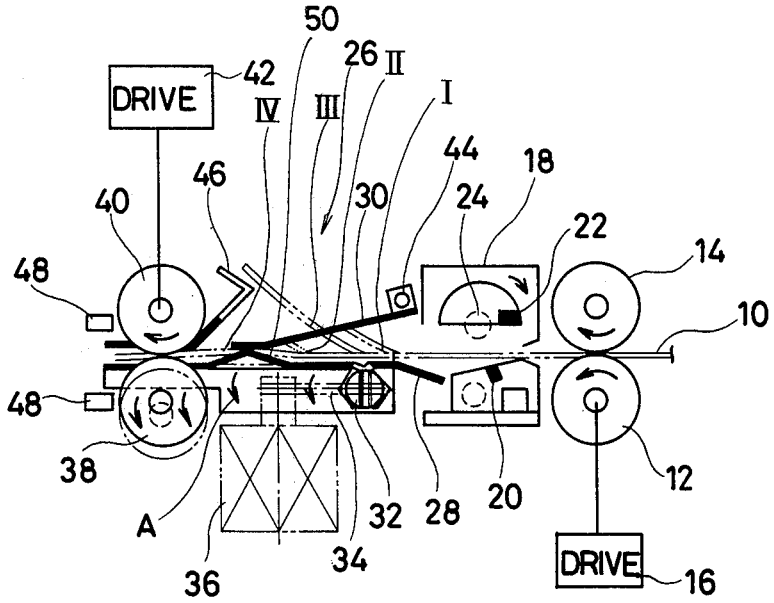
FIG. 1 is a side view of an essential part of an embodiment of a paper feeding and cutting system of the present invention.

Referring to FIG. 1, a roll paper is disposed in a facsimile device or an electrophotographic copying machine. A copy paper 10 drawn out from the roll paper is supplied to a paper feeding and cutting section of the present invention through a paper feed roller 12 and a pinch roller 14. A drive unit 16 is connected to the paper feed roller 12 in order to rotate the paper feed roller 12 at a desired speed in a desired timing. A cutting unit 18 is disposed near the paper feed roller 12 and the pinch roller 14. The cutting unit 18 includes a stationary blade 20 and a rotatable blade 22 which is driven to rotate around a shaft 24 at a desired timing to cut the copy paper 10 in a predetermined length.

A paper holding section 26 is provided at the downstream of the cutting unit 18, wherein the copy paper 10 supplied through the paper feed roller 12 and the pinch roller 14 is curled and maintained so that the predetermined length of the copy paper 10 is held in a short distance. The paper holding section 26 comprises a paper guide table 28 and a paper depressing guide plate 30.

The paper guide table 28 is secured to a shaft 32 which is fixed to one end of a solenoid lever 34. When a solenoid 36 is energized to attract the solenoid lever 34, the solenoid lever 34 is rotated around the shaft 32 and, hence, the paper guide table 28 is rotated by a predetermined angle in a direction shown by an arrow A. A pinch roller 38 is mounted on the end of the paper guide table 28, which is associated with a paper feed roller 40 to catch the leading edge of the copy paper 10 supplied through the paper feed roller 12 and the pinch roller 14. A drive unit 42 is connected to the paper feed roller 40 to rotate the paper feed roller 40 at a desired speed in a predetermined timing.

When the leading edge of the copy paper 10 reaches the paper guide table 28 after passing the cutting unit 18, the solenoid 36 is energized to attract the solenoid lever 34. Accordingly, the paper guide table 28 is rotated by a predetermined angle in a direction shown by an arrow A. The pinch roller 38 mounted on the paper guide table 28 is shifted downward as shown by a chain line to provide a gap between the paper feed roller 40 to which the leading edge of the copy paper 10 is inserted. Since the paper depressing guide plate 30 is rotatably supported around a shaft 44, the paper depressing guide plate 30 functions to depress the leading edge of the copy paper 10 through the use of the weight of the paper depressing guide plate 30 so that the leading edge of the copy paper 10 is properly led to the gap temporarily formed between the pinch roller 38 and the paper feed roller 40. A guide angle 46 is disposed near the paper feed roller 40 in order to facilitate the introduction of the leading edge of the copy paper 10 into the gap temporarily formed between the pinch roller 38 and the paper feed roller 40.

The leading edge of the copy paper 10 derived from the roll paper tends to bend as shown by chain lines I and II in FIG. 1. If the paper depressing guide plate 30 is not provided, the copy paper 10 may travel as shown by a chain line III. In this case, the leading edge of the copy paper 10 will not be led toward the gap temporarily formed between the pinch roller 38 and the paper feed roller 40. Because of the provision of the paper depressing guide plate 30, the leading edge of the copy paper 10 is properly introduced into the gap, as shown by a chain line IV, formed between the pinch roller 38 and the paper feed roller 40. A cut portion is formed in the guide angle 46 in order not to disturb the rotation of the paper depressing guide plate 30.

A sensor unit 48 is disposed at the downstream of the pinch roller 38 and the paper feed roller 40. When the leading edge of the copy paper 10 reaches the sensor unit 48, the solenoid 36 is deenergized to return the solenoid lever 34, the shaft 32, the paper guide table 28 and the pinch roller 38 to the initial position. The leading edge of copy paper 10 introduced into the gap temporarily formed between the pinch roller 38 and the paper feed roller 40 is tightly caught by the pinch roller 38 and the paper feed roller 40. At this moment, the paper feed roller 40 is not driven to rotate, and the paper feed roller 12 is driven to continue the rotation.

A protruded portion 50 is formed in the paper guide table 28 to provide an upward impact force against the copy paper 10 when the paper guide table 28 is returned to the initial position by the deenergization of the solenoid 36. The leading edge of the copy paper 10 is stationary held by the pinch roller 38 and the paper feed roller 40, and the paper feed roller 12 and the pinch roller 14 further supply the copy paper 10 toward the paper holding section 26. Therefore, the copy paper 10 is curled in the paper holding section 26 against the depression force created by the paper depressing guide plate 30 as shown by a solid line V in FIG. 2.

During the curling operation, the paper depressing guide plate 30 functions as a load against the curl formation. The deformation stress for curling the copy paper around the center of the copy paper 10 is several tens grams, and the deformation stress at the leading edge of the copy paper 10 is several grams when the copy paper of the size $A_4$ is employed. Accordingly, the depression force of the paper depressing guide plate 30 is selected about ten grams to ensure a stable paper feed operation and the curling operation.

Figure 2:
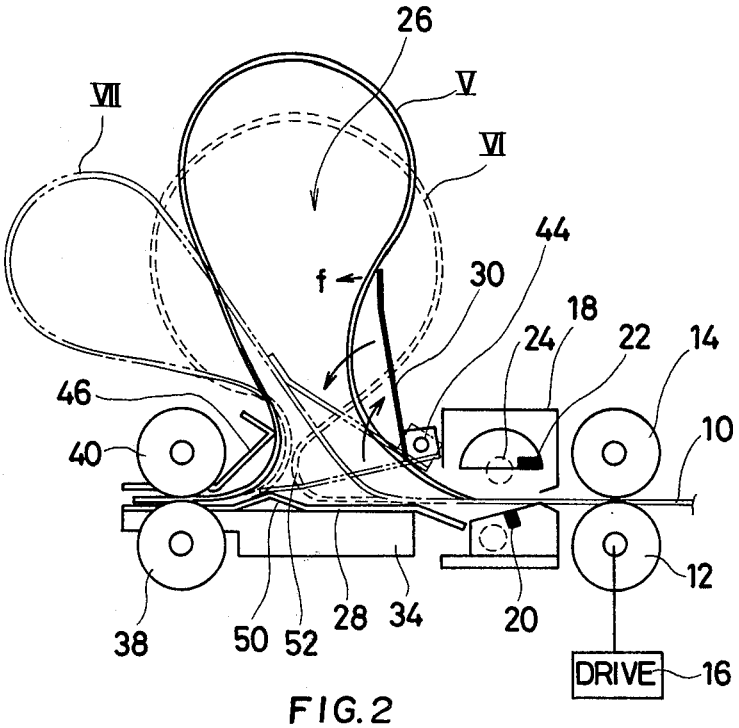
FIG. 2 is a side view showing an operation mode of the paper feeding and cutting system of FIG. 1.

If the paper depressing guide plate 30 is not employed, the copy paper 10 supplied through the paper feed roller 12 and the pinch roller 14 may be deeply bent as shown by a broken line VI in FIG. 2 due to the weight of the copy paper 10. The thus bent portion 52 will cause the jam of the paper supply. That is, the paper depressing guide plate 30 functions to apply the forward depressing force f at the beginning of the curling operation, thereby preventing the copy paper 10 from deeply bending. A chain line VII in FIG. 2 shows a condition at the beginning of the curling operation.

In a manner as discussed above, the copy paper 10 derived from the roll paper is supplied to the paper holding section 26 through the paper feed roller 12 and the pinch 14 and curled therein. When a preselected holding period has passed, the rotation of the paper feed roller 12 is terminated. At this moment, the copy paper 10 of a predetermined length is maintained in the paper holding section 26, and the trailing edge of the copy paper 10 is cut by the cutting unit 18. Thereafter, the paper feed roller 40 is driven to rotate by the drive unit 42 to transfer the copy paper 10 of the predetermined length to the following section through the paper feed roller 40 and the pinch roller 38. When the trailing edge of the copy paper 10 is detected by the sensor unit 48, the rotation of the paper feed roller 40 is terminated, and the system is prepared for the next copy paper supplying operation.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A copy paper feeding system comprising in combination;

paper feed means for feeding a copy paper at a predetermined speed;

catching means for holding the leading edge of the copy paper applied through said paper feed means, said catching means comprising a feed roller connected to a drive source, a pinch roller associated with said feed roller, and a shift means for shifting said pinch roller for temporarily forming a gap between said feed roller and said pinch roller, thereby allowing the leading edge of the copy paper to be introduced between said feed roller and said pinch roller;

means for sensing the leading edge of said copy paper as it passes between said temporarily formed gap, said sensing means thus reversing said shift means, thereby returning the pinch roller to an initial closed position, thus tightly catching said leading edge of the copy paper therebetween; and a paper holding section disposed between said paper feed means and said catching means, said paper holding section including a paper guide means and a paper depressing plate rotatably supported by a shaft for applying a depression force to said copy paper as the copy paper is introduced into said paper holding section, depressing the leading edge of said copy paper so as to direct said leading edge into the gap formed between said feed roller and said pinch roller of said catching means, said depressing plate further functioning to continue to apply a depression force to said copy paper during the curling of said paper when the leading edge thereof is held by said catching means in said closed position as said paper feed means continuously supplies the copy paper.

2. The copy paper feeding system of claim 1, further comprising: cutter means disposed between said paper feed means and said paper holding section for cutting the copy paper when a predetermined length of the copy paper is held in said paper holding section.

3. The copy paper feeding system of claim 2, wherein said copy paper is drawn out from a roll paper and supplied to said paper feed means.

* * * * *